US006875117B2

(12) United States Patent
Ransil et al.

(10) Patent No.: US 6,875,117 B2
(45) Date of Patent: Apr. 5, 2005

(54) SWING DRIVE MECHANISM

(75) Inventors: Matthew J. Ransil, Stevens, PA (US); James Michael Dillner, Leola, PA (US); Dennis R. Stauffer, Birdsboro, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/304,013

(22) Filed: Nov. 26, 2002

(65) Prior Publication Data

US 2004/0102253 A1 May 27, 2004

(51) Int. Cl.[7] ..... A63G 9/16
(52) U.S. Cl. ..... 472/119
(58) Field of Search ..... 472/118–125; 74/25, 42, 411, 425

(56) References Cited

U.S. PATENT DOCUMENTS

| | | | | | |
|---|---|---|---|---|---|
| 4,452,446 | A | | 6/1984 | Saint | |
| 4,785,678 | A | * | 11/1988 | McGugan et al. | 74/42 |
| 5,083,773 | A | | 1/1992 | Saint | |
| 5,525,113 | A | | 6/1996 | Mitchell et al. | |
| 5,769,727 | A | * | 6/1998 | Fair et al. | 472/118 |
| 5,791,999 | A | | 8/1998 | Lauro et al. | |
| 5,833,545 | A | | 11/1998 | Pinch et al. | |
| 5,846,136 | A | | 12/1998 | Wu | |
| 6,022,277 | A | | 2/2000 | Jankowski | |
| 6,059,667 | A | | 5/2000 | Pinch | |
| 6,193,224 | B1 | | 2/2001 | Dillner et al. | |
| 6,283,870 | B1 | * | 9/2001 | Saint et al. | 472/119 |
| 6,339,304 | B1 | | 1/2002 | Allison et al. | |
| 6,386,986 | B1 | | 5/2002 | Sonner et al. | |
| 6,471,597 | B1 | * | 10/2002 | Flannery et al. | 472/119 |
| 6,520,862 | B1 | | 2/2003 | Armbruster et al. | |

OTHER PUBLICATIONS

Photographs of Kolcraft Perfect Height Swing® (5 photographs), date undetermined.

* cited by examiner

*Primary Examiner*—K. T. Nguyen
(74) *Attorney, Agent, or Firm*—Foley & Lardner LLP

(57) ABSTRACT

A swing drive mechanism for a swing having a swing seat, at least one hanger arm supporting the swing seat, and a pivot shaft providing reciprocal motion to the swing seat via the at least one hanger arm is described. The drive mechanism may include a gear, an eccentric element coupled to the gear and a motor mechanism configured to drive the gear. The drive mechanism may also include a substantially elongated drive link having a proximal end and a distal end, the proximal end coupled to the gear via the eccentric element, and a spring coupled to, and configured to being driven by, the distal end of the drive link. The spring being configured to directly drive the pivot shaft in a reciprocal fashion. A swing drive assembly including a blade and pivot shaft is also described.

24 Claims, 8 Drawing Sheets

SWING DRIVE MECHANISM

FIELD OF THE INVENTION

This invention relates to a swing drive mechanism. More specifically, this invention relates to a swing drive mechanism for a child swing.

BACKGROUND OF THE INVENTION

Various types of swings are known in the art. Typically, swings include a support frame, a hanger pivotably attached to the support frame, and a seat attached to the hanger. Electrically powered drive mechanisms are utilized to supply energy to the swing to move the swing in a reciprocal motion back and forth.

U.S. Pat. No. 6,193,224 to Dillner et al, which is commonly assigned to the assignee of the present invention and is hereby incorporated by reference in its entirety, discloses one such swing drive mechanism. The Dillner et al. swing includes a swing drive mechanism that has a motor driving a crank arm. The crank arm is associated with an input mechanism that translates the rotational motion of the crank arm into an arcuately oscillating motion of the input mechanism. A torsion spring is connected to the input mechanism and to an output mechanism having an axle. The axle is connected to a hanger arm. The torsion spring couples the input mechanism to the output mechanism to allow the axle to be driven in a reciprocal fashion. The axle is supported in part by a ball bearing or bearings.

Another known swing drive mechanism includes two worm gears driven by a worm. The worm gears include eccentric drive pins to which are attached respective extension springs. The springs in turn are attached directly to a suspension arm for supporting a swing seat.

Yet another known swing drive mechanism has a worm engaging a worm gear. The worm gear has an eccentric pin which slidingly engages an elongated slot of a link. The link is mounted to an axle so as to allow the axle to rotate with the link when the link is driven by the worm gear, and this in turn drives a pendent arm to swing.

A further known swing drive mechanism also includes a worm gear with an eccentric pin. In this mechanism, the worm gear drives a linkage and a pivot arm coupled to an output shaft to impart pivoting motion to the output shaft. In both this mechanism and the mechanism described in the preceding paragraph, the link or pivot is coupled directly to a cross axle or output shaft to provide motion to the swing hanger arms.

SUMMARY OF THE INVENTION

An aspect of the present invention relates to a swing drive mechanism for a swing having a swing seat, at least one hanger arm supporting the swing seat, and a pivot shaft providing reciprocal motion to the swing seat via the at least one hanger arm. The drive mechanism comprises a gear; an eccentric element coupled to the gear; a motor mechanism configured to drive the gear; a substantially elongated drive link having a proximal end and a distal end, the proximal end coupled to the gear via the eccentric element; and a spring coupled to, and configured to being driven by, the distal end of the drive link, the spring being configured to directly drive the pivot shaft in a reciprocal fashion.

Another aspect of the present invention relates to a swing drive mechanism for a swing having a swing seat, at least one hanger arm supporting the swing seat, and a pivot shaft providing reciprocal motion to the swing seat via the at least one hanger arm. The drive mechanism comprises a gear; an eccentric element coupled to the gear; a motor mechanism configured to drive the gear; a substantially elongated drive link having a proximal end and a distal end, the proximal end coupled to the gear via the eccentric element; and a spring coupled to, and configured to being driven by, the distal end of the drive link, and configured to drive the pivot shaft, wherein the gear, drive link and spring are disposed in substantially the same plane.

Another aspect of the present invention relates to a swing drive mechanism for a swing having a swing seat, at least one hanger arm supporting the swing seat, and a pivot shaft providing reciprocal motion to the swing seat via the at least one hanger arm. The drive mechanism comprises a gear; an eccentric element coupled to the gear; a motor mechanism configured to drive the gear; a substantially elongated drive link having a proximal end and a distal end, the proximal end coupled to the gear via the eccentric element; and a spring coupled to, and configured to being driven by, the distal end of the drive link, the spring being configured to directly drive the pivot shaft in a reciprocal fashion, wherein the gear, spring and pivot shaft rotate about respective axes, the respective axes being substantially parallel.

Another aspect of the present invention relates to a swing drive mechanism for a swing having a swing seat, at least one hanger arm supporting the swing seat, and a pivot shaft providing reciprocal motion to the swing seat via the at least one hanger arm. The drive mechanism comprises an input bracket which includes a crank engagement portion, an axle contacting portion, and a spring coupling portion. The drive mechanism also comprises a pivot shaft engagement element configured to engage the pivot shaft, and at least one elongated spring coupling the spring coupling portion to the pivot shaft engagement element.

Another aspect of the present invention relates to a swing drive assembly of a swing. The assembly comprises at least one hanger arm adapted for supporting a swing seat; a blade mounted to a frame of the swing; a pivot shaft engaged with the at least one hanger arm to drive the at least one hanger arm in reciprocal motion, the pivot shaft having a section with a surface shaped in an inverted V, the section being supported by the blade at the surface; and a drive mechanism adapted for driving the pivot shaft in a reciprocal fashion.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
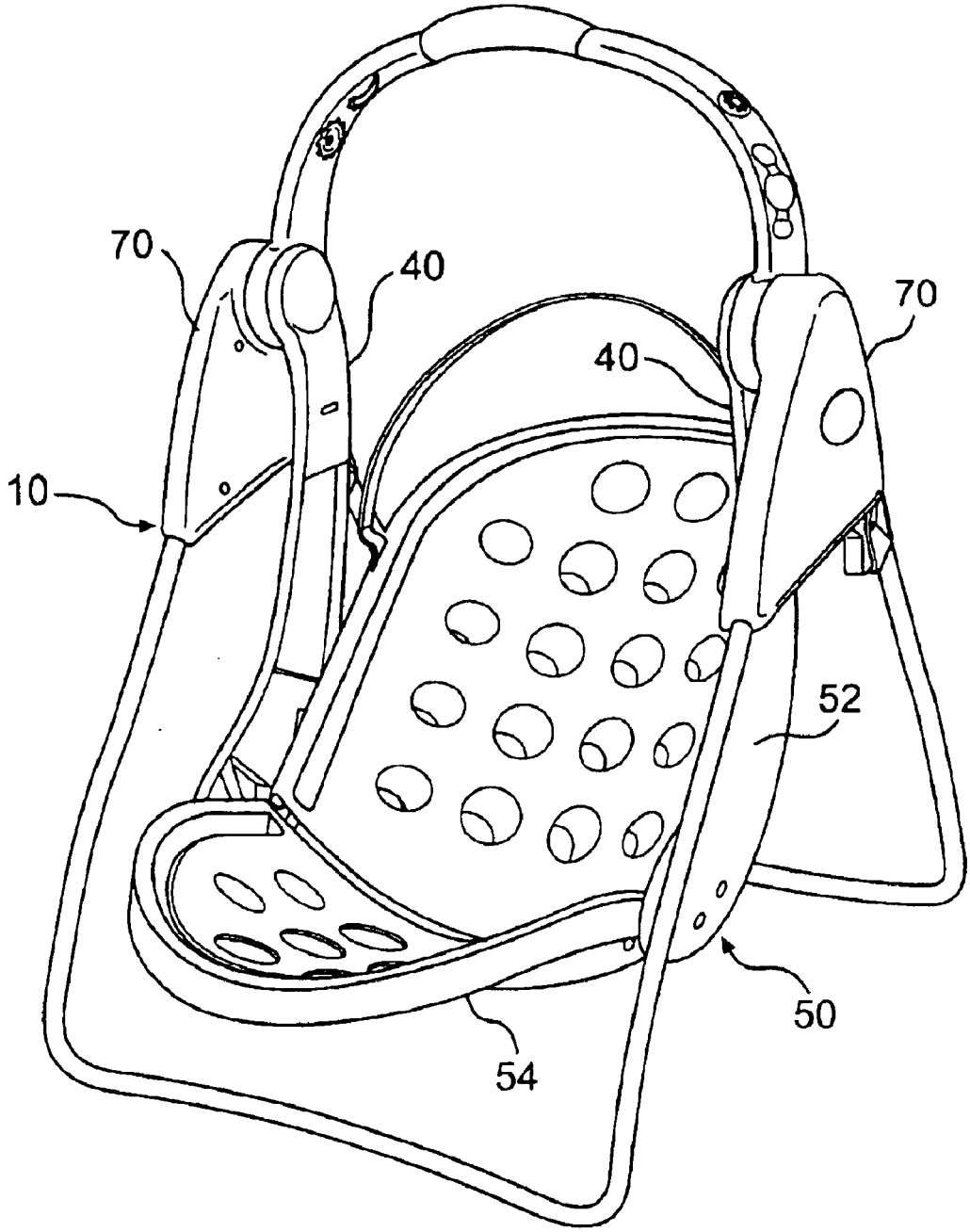
FIG. 1 illustrates a swing incorporating a swing drive assembly and a swing drive mechanism according to an exemplary embodiment of the present invention.

FIG. 1 illustrates a swing incorporating a swing drive assembly and a swing drive mechanism according to an exemplary embodiment of the present invention. The swing includes a support frame 10 and a pair of hanger arms 40 supporting a seat 50. The seat 50 comprises a seat back 52 and a seat bottom 54. Preferably the swing is compact and portable.

The support frame 10 includes housings 70. At least one of the housings 70 may contain a swing drive mechanism (not shown in FIG. 1) in accordance with the present invention.

Figure 2:
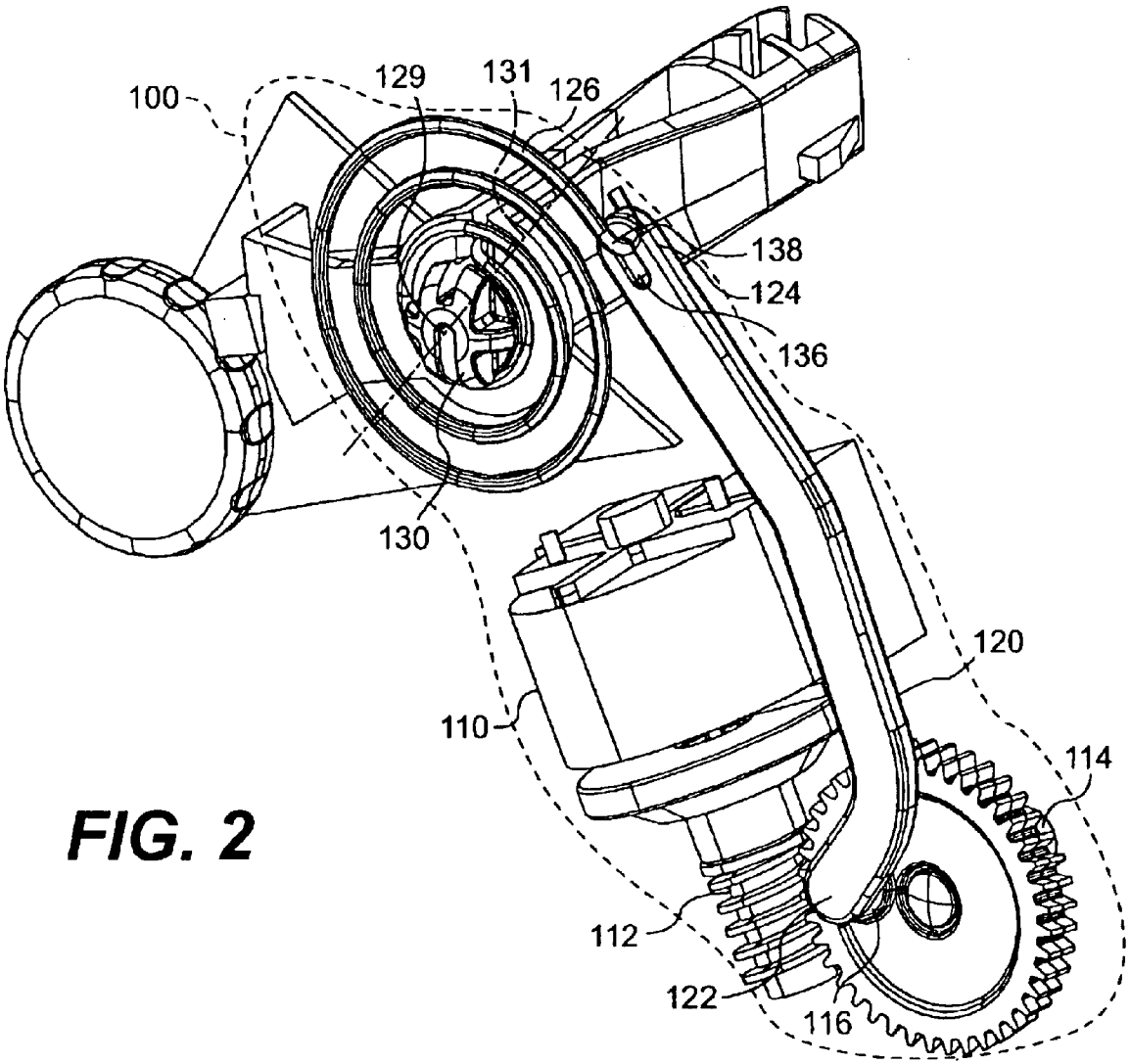
FIG. 2 illustrates a swing drive mechanism according to an exemplary embodiment of the present invention.

FIG. 2 illustrates a swing drive mechanism 100 according to an exemplary embodiment of the present invention within the housing 70. The swing drive mechanism 100 is shown within dashed lines. The swing drive mechanism 100 comprises a motor mechanism 110 with a worm 112. The worm 112 engages and drives a worm gear 114 to rotate the gear 114 about its axis when the worm 112 is driven by the motor mechanism 110.

The worm gear 114 includes an eccentric element 116 which is coupled to and engages a substantially elongated drive link 120 at a proximate end 122 of the substantially elongated drive link 120. The eccentric element 116 may be a pin, such as a steel pin. Alternatively, the eccentric element 116 may be integral to the drive link 120 instead of the worm gear 114 or integral to neither of the drive link 120 and the worm gear 114. The eccentric element 116 may be a snap attached to the drive link 120. In any case, the eccentric element 116 is coupled to the worm gear 114. The rotational motion of the worm gear 114 is converted to a reciprocal back and forth linear motion in the drive link 120. The elongated drive link 120 is coupled to a spring 126 at a distal end 124 of the elongated drive link 120.

The back-and-forth motion of the drive link 120 causes the spring 126 to rotate about its central axis. The spring 126 is coupled to a pivot shaft 130, which provides the reciprocal motion to the swing seat 50 (see FIG. 1) via one of the hanger arms 40 (see FIG. 1) engaging the pivot shaft 130. The pivot shaft 130 is not part of the swing drive mechanism 100, but it is shown to illustrate the swing drive mechanism in context. The spring 126, when driven by the drive link 120, directly drives the pivot shaft 130. In other words, there is no element between the spring 126 and the pivot shaft 130 that couples the motion of the spring 126 to that of the pivot shaft 130.

Further because the pivot shaft 130, spring 126, eccentric element 116 and worm gear 114 have centerlines that are all parallel, these relatively thin components can line up with a minimal amount of space, thus providing compactness for the swing drive mechanism. The center line of the motor mechanism 110 is perpendicular to these other center lines, but this favorably orients the motor in substantially the same plane as these other components, again providing compactness.

Preferably the spring 126, the drive link 120, and the worm gear 114 (via at least the eccentric element 116) are substantially all in the same plane. This allows for elements, i.e., the swing drive mechanism 100, including the motor mechanism 110, the worm 112, the worm gear 114, drive link 120, and spring 126, to be arranged in a compact fashion, such that the swing drive mechanism 100 may be compactly arranged within the housing 70 (see FIG. 3). In this regard, the respective axes of rotation of the spring 126, the worm gear 114, and the pivot shaft 130 are all substantially along the same direction.

The spring 126 may comprise music wire, for example, or be formed from flat spring steel stock. In addition, the spring 126 may be any type, such as a torsion, extension, or compression spring. The spring 126 is preferably a coil spring, where the coils are substantially all in the same plane. This allows for a more compact swing drive mechanism, because such a coiled spring takes up less space along the rotational axis of the spring. Another advantage to having spiral coils in substantially the same plane is reduced coil-to-coil rub, thus reducing friction. The noise of the mechanism is also reduced.

Figure 3:
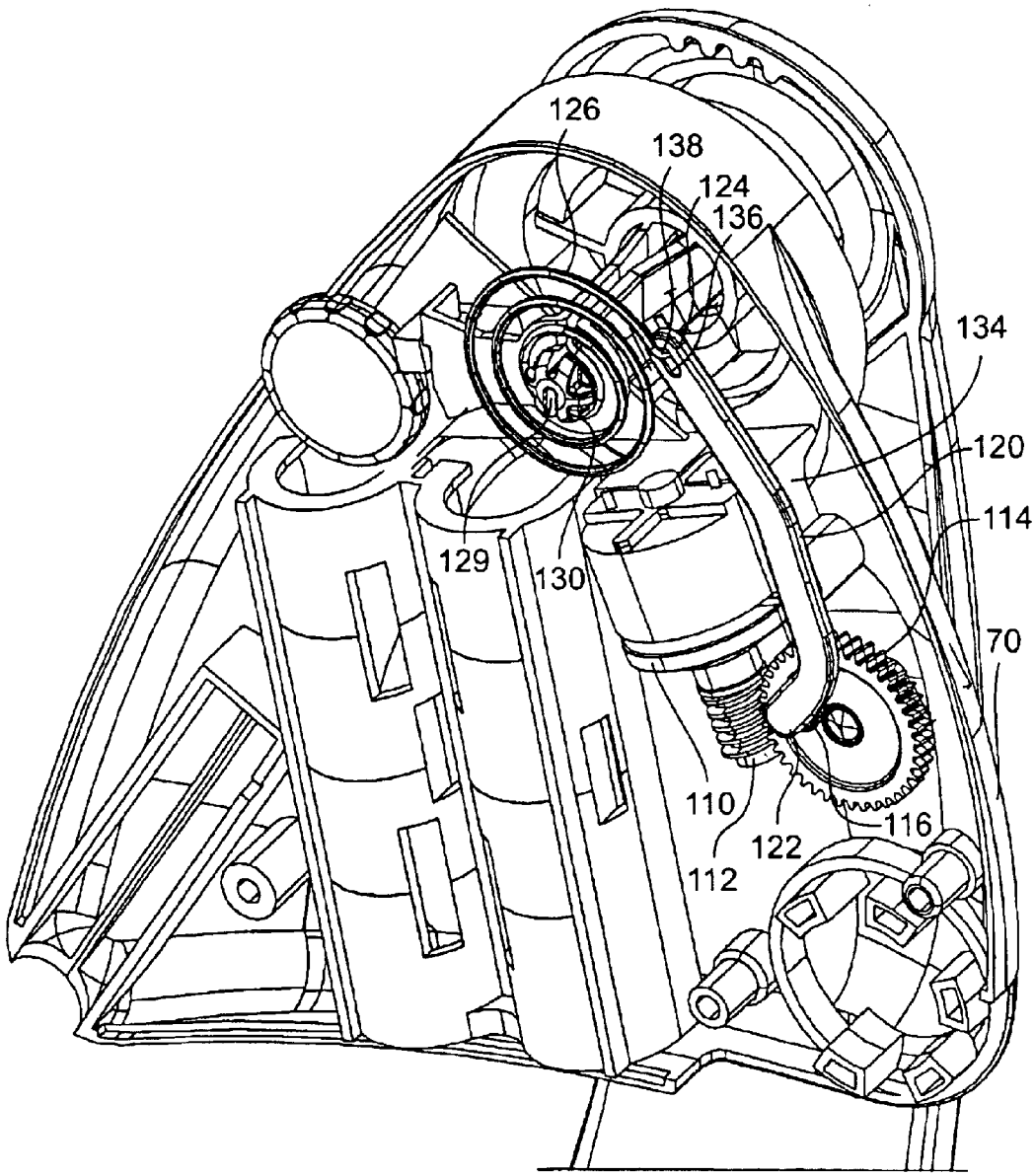
FIG. 3 illustrates a swing drive mechanism according to the embodiment of FIG. 2 attached to a housing of a swing according to an exemplary embodiment of the present invention.

The motor mechanism 110 may be mounted directly to the housing 70 as shown in the cut away view of FIG. 3. The motor mechanism 110 is sandwiched between the sides of the housing 70 when the housing is assembled. This eliminates the need for a separate motor strap and screw. The motor mechanism 110 may also be retained in the housing 70 by other means, such as screws or clips, for example.

Returning to FIG. 2, the drive link 120 is preferably arranged such that it transfers the torque from the gear 114 to the spring 126 when it pulls on the spring 126. This is accomplished by arranging the drive link 120 such that the distance from the center of rotation 129 of the spring 126 to the link's contact point with the spring 126 remains substantially constant while the drive link 120 is driven, and such that the direction along which the drive link 120 moves is substantially perpendicular to a radial line 131 from the spring's center of rotation 129 to the point where the drive link 120 contacts the spring 126. By transferring the motor torque to the spring 126, the spring 126 can absorb energy and release it at the proper time so as to match the frequency of the swing seat 50 and keep the motor mechanism 110 in sync as the torque builds up in the spring 126. The drive link 120 provides resistance back to the gear 114 which slows the motor mechanism 110 and prevents the motor mechanism 110 from getting out of sync.

Preferably the drive link 120 has a slot 136 sized to provide a dwell time when the pivot shaft 130 is driven. The dwell time is a time period when the motor mechanism 110 is activated and drives the worm 112, but the spring 126 is not driven. In this regard, the slot 136 is sufficiently elongated such that, during a portion of the time that the motor mechanism 110 is activated, the drive link 120 is driven, but the link 120 does not provide a torque on the spring 126. The length of the dwell time can be increased by increasing the length of the slot 136.

The slot 136 allows for a dwell time where the energy stored in the spring 126 can be released without the motor mechanism 110 creating a torque to work against the spring 126. This dwell time allows the seat 50 to finish moving forward or rearward freely.

The dwell time slot 136 provides flexibility in the torque required to start the swing motion, and thus the motor voltage required to start the motion. In general, the torque required to start the swing in motion will depend upon the weight in the seat 50 of the swing, i.e., the child's weight, and the initial recline angle that the hanger arm makes with the vertical. For many conventional swings which employ a direct connection to a pivot shaft, the motor voltage required to start the swing motion will depend on both this weight and angle, and the motor voltage must be adjusted accordingly. The dwell time slot as employed in this embodiment, however, allows for a range of motor voltages to be appropriate for a particular weight and angle. Thus, in this swing drive mechanism embodiment with dwell time slot 136, a relatively small motor voltage range, or even a single voltage, to start the swing motion would be appropriate for a range of weights and angles. The dwell time slot 136 also allows for a specific voltage to be used to start the swing with a variety of operating conditions. These operating conditions are determined by the weight in the swing seat 50, the center of gravity and the amount of swing recline.

The slot 136 may be implemented either at the proximal end 122 of the link 120 where it contacts the eccentric element 116, or at the distal end 124 of the link 120 where it contacts the spring 126. When the distal end 124 has the slot, an end region 138 of the spring 126 is located within the slot 136, but not engaged with the link 120, so that the link 120 does not pull on the spring 126 during the dwell time. The spring 126 may be located in the slot 136 via a U-shaped hook at the end region 138 of the spring 126 as shown in FIG. 2. The U-shaped hook eliminates the need for an additional pivot pin. When the proximal end 122 of the link 120 has the slot 136, the eccentric element 116 is located within the slot 136, but not engaged with the link 120 during the dwell time, so that the link 120 does not pull on the spring 136 during the dwell time.

Figure 4:
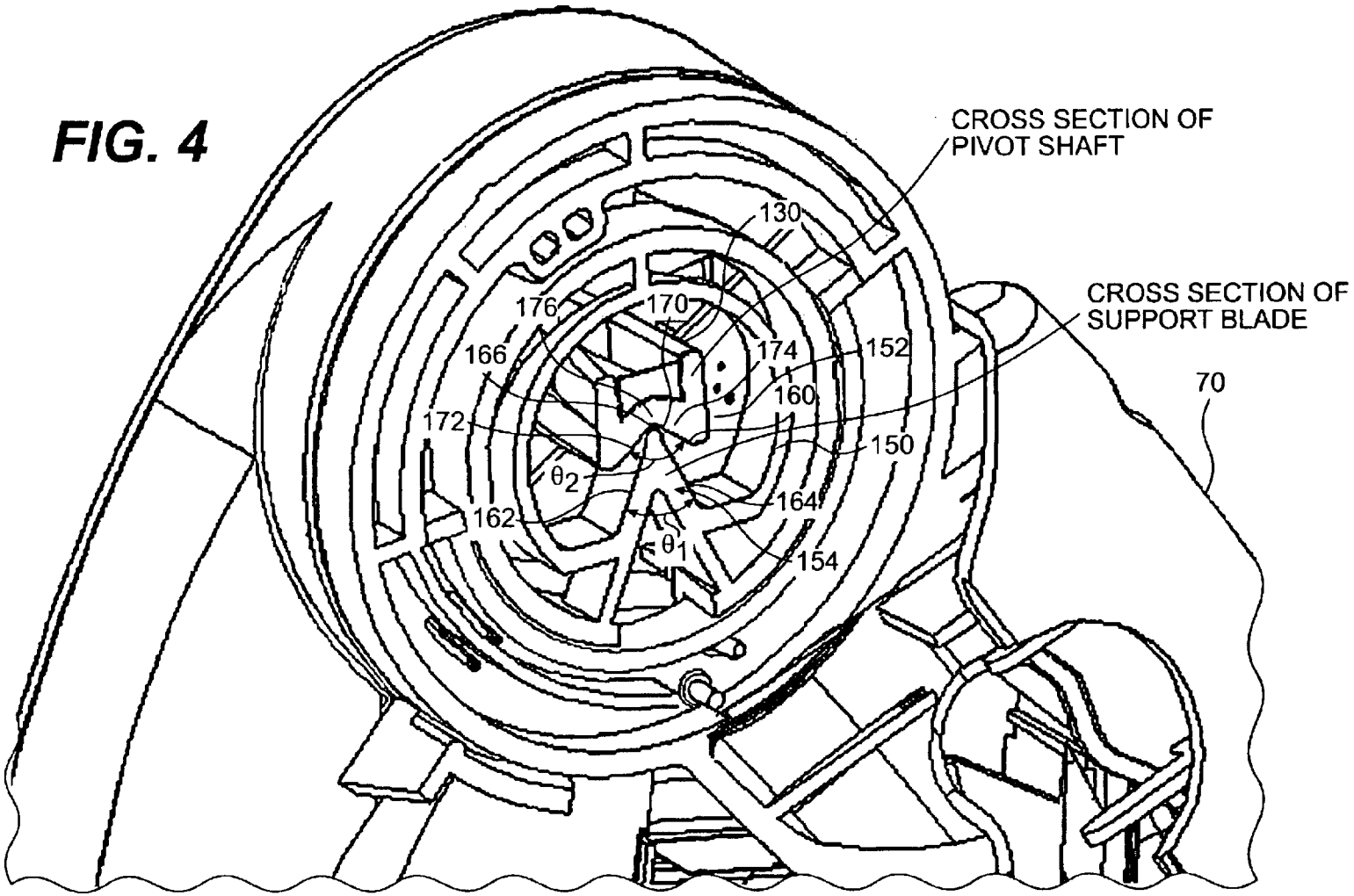
FIG. 4 illustrates a swing drive assembly including a blade supporting a pivot shaft according to an exemplary embodiment of the present invention.

FIG. 4 illustrates the housing 70 with a support member 150 extending from the housing 70 for supporting the pivot shaft 130. Preferably the support member 150 is molded as part of the housing 70. In this regard, the support member 150 has a central aperture 152 through which the pivot shaft 130 passes, and includes a blade 154, upon which the pivot shaft 130 rests. The pivot shaft 130 has a lower surface section 160 in the shape of an inverted V. The pivot shaft 130 rests on, and is supported by, the blade 154 as the pivot shaft 130 is driven by the swing drive mechanism. The pivot shaft 130 is in turn coupled to one of the hanger arms (shown in FIG. 1) and imparts reciprocal motion to that hanger arm. The swing drive mechanism may be on the side of the housing 70 opposite the side where the driven hanger arm is located. Beneficially, the blade 154 and the pivot shaft 130 are configured and arranged so that the pivot shaft 130 may be supported by the blade 154 without the need for additional support elements, such as ball bearings. This structure is now described.

The blade 154 preferably has a cross section shaped as a wedge or as a triangle, and preferably has two sides 162,164 that meet at a top vertex 166. The two sides 162,164 make an angle $\theta_1$ with respect to each other. As the pivot shaft 130 rotates back and forth, the lower surface 160 is supported by the point of the blade 154 at the vertex 166. The lower surface 160 of the pivot shaft 130, which is shaped as an inverted V, has first and second surfaces 172,174 that meet at the vertex 176 of the inverted V. The first and second surfaces 172, 174 make an angle $\theta_2$ with respect to each other. In order for the pivot shaft 130 to rotate freely back and forth on the blade 154, the angle $\theta_2$ should be larger than the angle $\theta_1$ by at least an amount equal to the maximum angular motion of the swing. Otherwise, before the swing could reach its maximum angular motion, one of the sides 162, 164 of the blade 154 would contact one of the respective first and second surfaces 172, 174, thus tending to limit further angular motion.

Preferably the difference between angles $\theta_2$ and $\theta_1$ should be only slightly greater the maximum angular motion of the swing. In this way the angle $\theta_2$ will be smaller, and thus sharper and will better resist side-to-side motion of the blade 154 on the lower surface 160.

Both the blade 154 and the pivot shaft 130 may be fabricated from a plastic material, for example. Preferably the pivot shaft 130 and blade 154 are fabricated from a low friction material such as acetal plastic. Low friction between the blade 154 and the pivot shaft 130 may also be achieved by using a material impregnated with lubricant for the shaft 130 and/or the blade 154.

Figure 5:
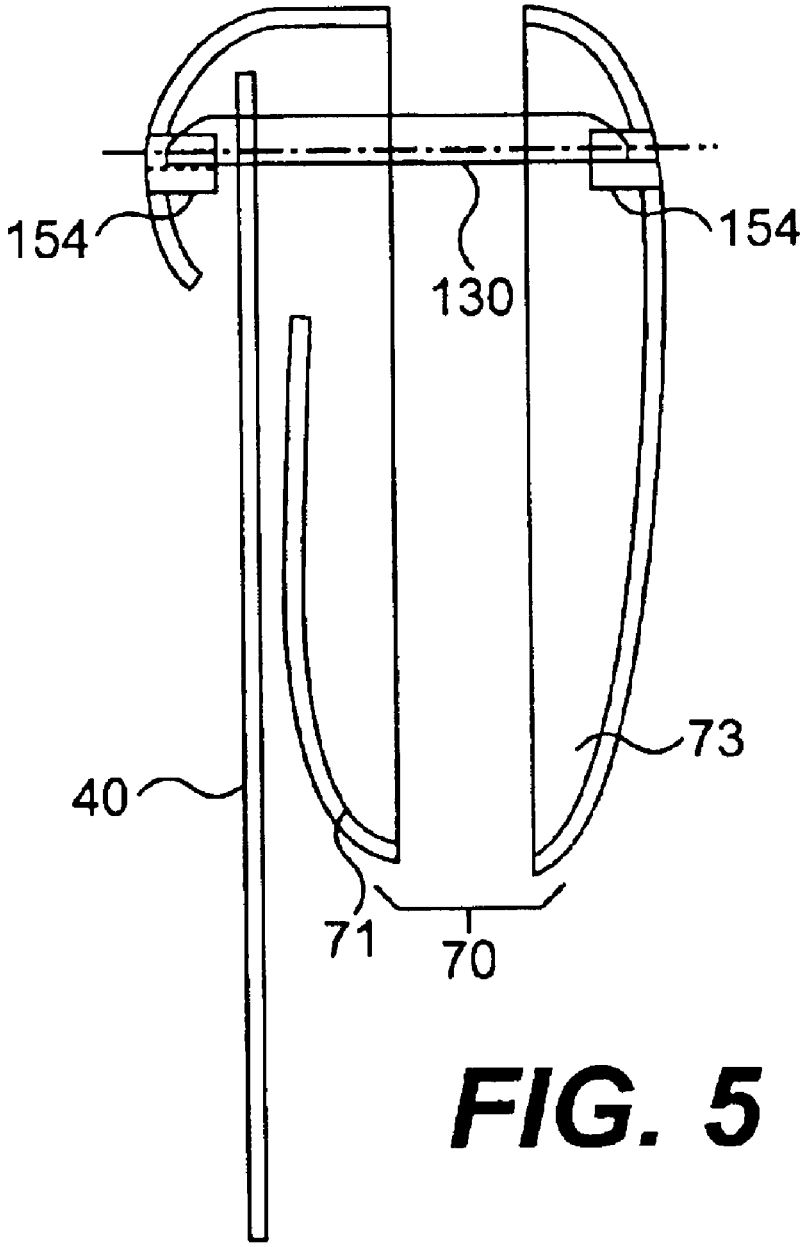
FIG. 5 is a side view illustrating a swing drive assembly including a blade supporting a pivot shaft on both sides of a hanger arm according to an exemplary embodiment of the present invention.
Figure 6:
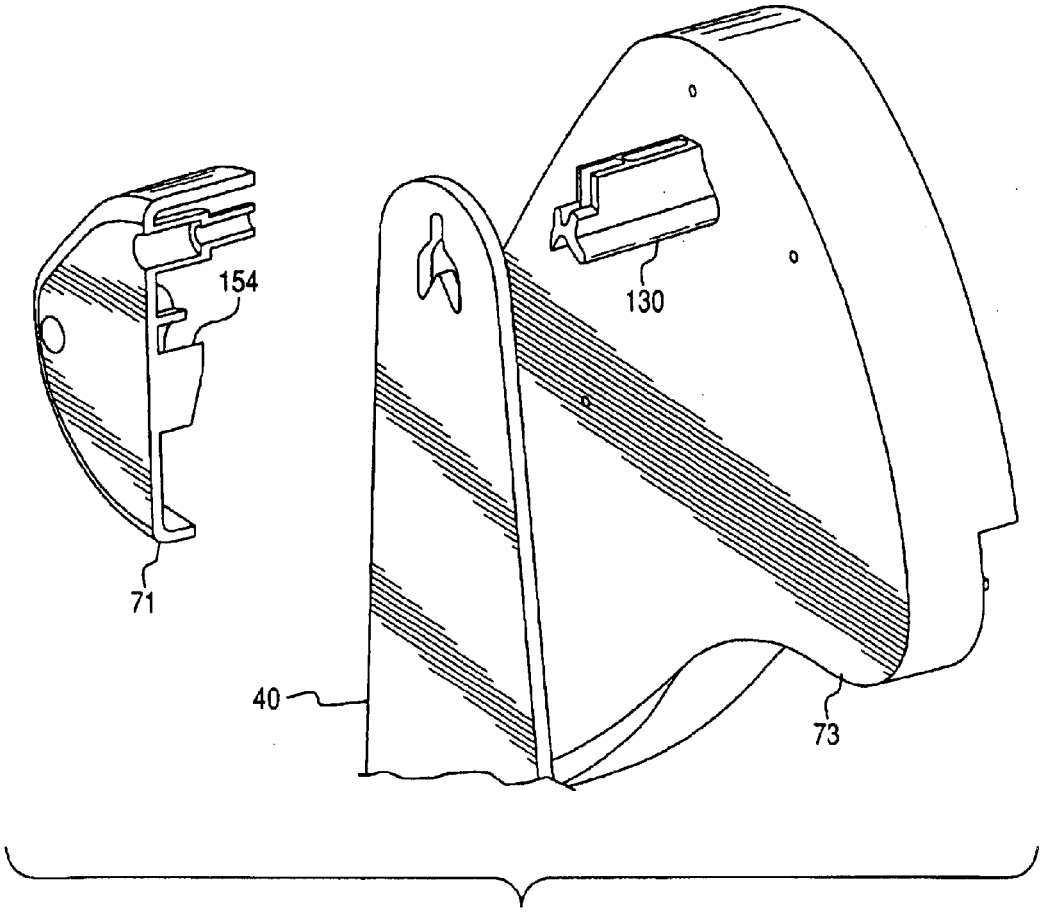
FIG. 6 is an exploded view illustrating a swing drive assembly including a blade supporting a pivot shaft on both sides of a hanger arm according to an exemplary embodiment of the present invention.

The blade 154 may extend on both sides of the hanger arms 40 to support the pivot shaft on both sides as shown in FIGS. 5 and 6. This arrangement reduces stress on the pivot shaft 130. In this case the blade 154 need not be unitary, but may comprise two blades, one on either side of the hanger arms 40. One of the blades 154 is attached or integral to an inner housing 71 of the housing 70 adjacent the hanger arm 40. The other one of the blades 154 is attached or integral to an outer housing 73 of the housing. When the hanger arm 40 is supported on both sides, the shaft is in double shear rather than having a cantilevered load. This reduces the stresses in the shaft thus allowing a less structural and cheaper plastic to be used for the shaft.

Figure 9:
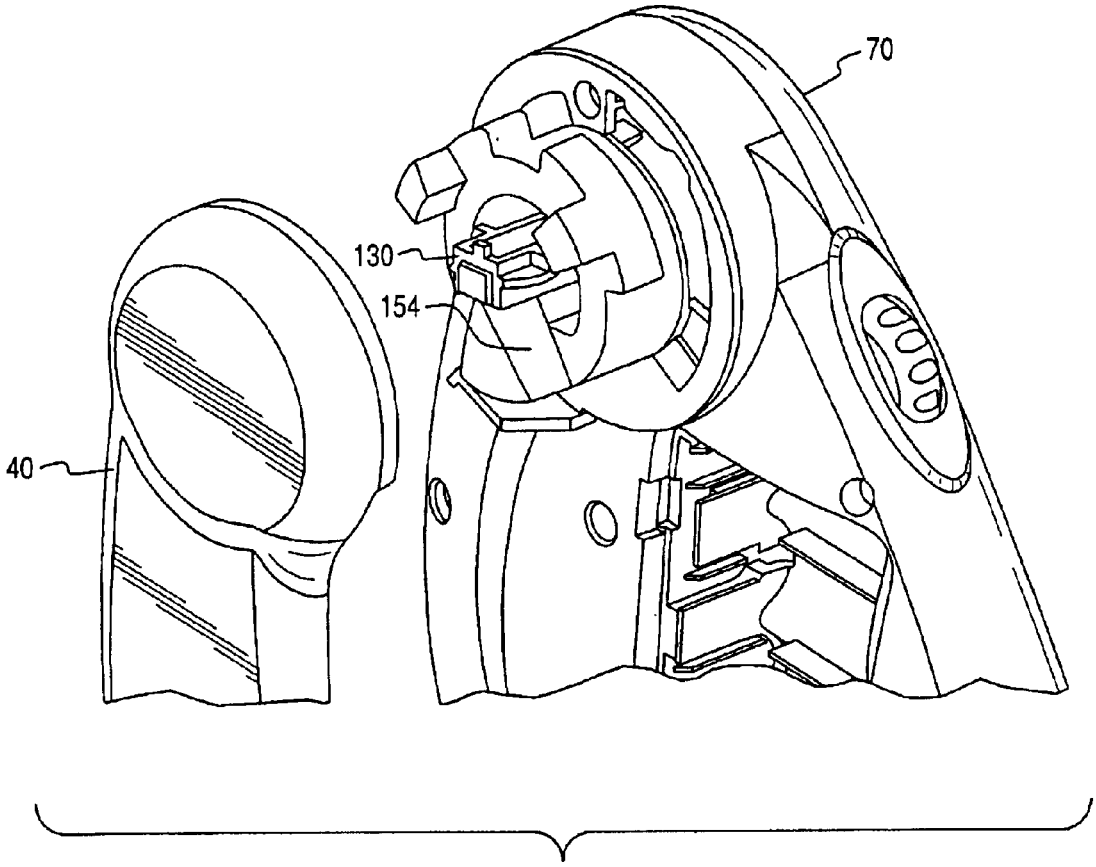
FIG. 9 is an exploded view illustrating a swing drive assembly including a blade supporting a pivot shaft on one side of a hanger arm according to an exemplary embodiment of the present invention.

Alternatively, the hanger arm 40 is not supported on both sides, but only on one side so that the hanger arm 40 is the innermost part as described with respect to FIGS. 9 and 4. In this case, the blade 154 may protrude from the housing 70 just far enough to be directly beneath the point where the pivot shaft 130 contacts the hanger arm 40. This arrangement prevents a shear or bending load on the pivot shaft while beneficially eliminating the need for a part of the housing 70 on the inside of the hanger arm 40.

Figure 7:
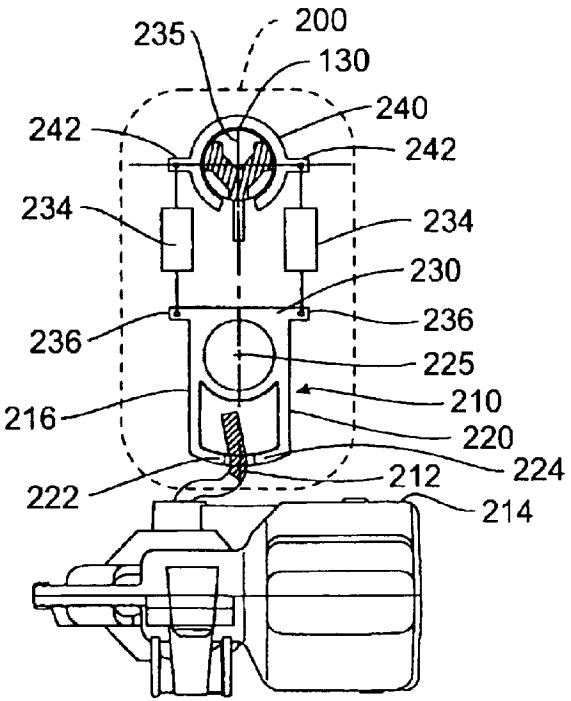
FIG. 7 illustrates a swing drive mechanism according to another exemplary embodiment of the present invention.

FIG. 7 illustrates a swing drive mechanism 200 according to another exemplary embodiment of the present invention. The swing drive mechanism 200 includes an input bracket 210, which is driven by a crank 212 of a motor mechanism 214. The input bracket 210 rotates about an axle contacting portion 216 of the input bracket 210. The axle contacting portion 216 contacts an axle (shown in FIG. 8) and rotates about a center axis of the axle. The axle contacting portion 216 may be fixed to the axle, and thus the input bracket 210 will rotate with the axle, or, if not fixed, the axle contacting portion 216 may rotate relative to and about the axle.

The input bracket 210 is driven in the following way. As the crank 212 rotates, the crank 212 alternately contacts a first crank engagement surface 222 and a second crank engagement surface 224 of a crank engagement portion 220 of the input bracket 210. The input bracket 210 converts the rotational motion of the crank 212 to a reciprocal arcuately oscillating motion of the input bracket 210. The input bracket 210 oscillates about a rotation axis 225 of the axle contacting portion 216. The first crank engagement surface 222 and the second crank engagement surface 224 of the crank engagement portion 220 may face each other.

The input bracket 210 also includes a spring coupling portion 230 that is coupled to at least one elongated spring 234. The at least one elongated spring 234 may be a coil spring, for example. The number of springs 234 may be two, for example, as shown in FIG. 7. The springs 234 may be coupled to the spring coupling portion 230 of the input bracket 210 by looping end portions of the springs 234 through holes 236 in the spring coupling portion 230.

This drive mechanism design provides advantages. Because the spring 234 is an elongated spring, the size of the input bracket may be less than an inch. Thus this design is compact. Further, the spring 234 and the spring coupling portion 230 are coupled to a part free from the seat assembly, and thus the drive mechanism can move independently of the seat assembly providing for a wider range of running amplitudes.

The springs 234 are in turn coupled to a pivot shaft engagement portion 240. The springs 234 may be coupled to the pivot shaft engagement portion 240 of the input bracket 210 by looping end portions of the springs 230 through holes 242 in the pivot shaft engagement portion 240. The pivot shaft engagement portion 240 engages a pivot shaft 130. The pivot shaft 130 is not part of the swing drive mechanism 200, but it is shown to illustrate the swing drive mechanism in context.

The pivot shaft 130 is driven in a reciprocal fashion to rotate back and forth in the following manner. As the input bracket 210 is driven back and forth by the crank 212, the spring coupling portion 230 drives the springs 234 back and forth in an essentially linear motion. When there are two springs 234, as illustrated in FIG. 7, as one of the springs 234 is driven in one direction, the other spring 234 is driven in the opposite direction. The springs 234 in turn cause the pivot shaft engagement portion 240 to oscillate in a rotational manner about a rotational axis 235 of the pivot shaft engagement portion 240. The pivot shaft 130, which is engaged to the pivot shaft engagement portion 240, will be driven by the pivot shaft engagement portion 240 to rotationally oscillate back and forth about the rotational axis 235. The pivot shaft 130, which is coupled to one of the hanger arms 40 (shown in FIG. 1), drives the hanger arm 40, and thus the swing seat 50 (shown in FIG. 1) back and forth.

Figure 8:
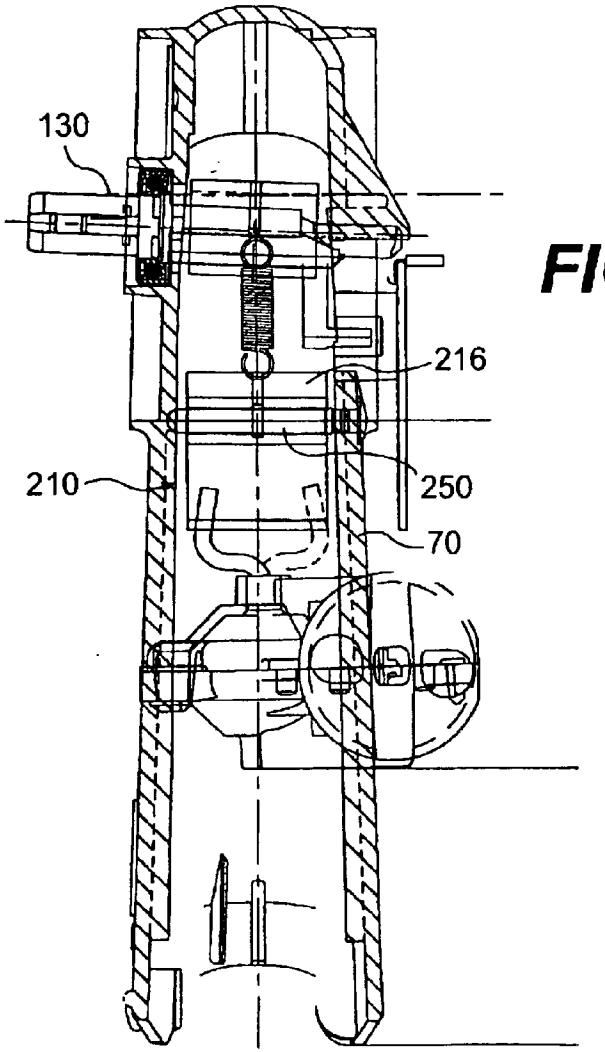
FIG. 8 illustrates a swing drive mechanism according to the embodiment of FIG. 7 within a housing of a swing according to an exemplary embodiment of the present invention.

FIG. 8 illustrates the swing drive mechanism of the embodiment of FIG. 7 within a housing 70 of the swing and illustrates the pivot shaft 130 passing through housing 70. The axle contacting portion 216 of the input bracket 210 is shown in contact-with an axle 250, which is fixed relative to the housing 70. In this case, the input bracket 210 rotates about the axle 250. Beneficially the elements of the swing drive are in substantially the same plane, thus providing a compact arrangement.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A swing drive mechanism and pivot shaft combination for a swing having a swing seat and at least one hanger arm supporting the swing seat, the drive mechanism and pivot shaft combination comprising:

a gear;

an eccentric element coupled to the gear;

a motor mechanism configured to drive the gear;

a substantially elongated drive link having a proximal end and a distal end, the proximal end coupled to the gear via the eccentric element; and a spring coupled to, and configured to being driven by, the distal end of the drive link, the spring directly driving the pivot shaft in a reciprocal fashion, wherein the pivot shaft is adapted to provide reciprocal motion to the swing seat via the at least one hanger arm.

2. The swing drive mechanism and pivot shaft combination of claim 1, wherein the gear is a worm gear.

3. The swing drive mechanism and pivot shaft combination of claim 1, wherein the link has a slot proximate to one of the distal end and the proximal end, and wherein the spring is coupled to the drive link at the slot, and the slot is sized to provide a dwell time when the spring is driven by the drive link.

4. The swing drive mechanism and pivot shaft combination of claim 1, wherein the spring is one of a spiral spring, a torsion spring, an extension spring, and a compression spring.

5. The swing drive mechanism and pivot shaft combination of claim 1, wherein the eccentric element is one of a pin and a snap.

6. A swing drive assembly comprising:

a housing; and the swing drive mechanism of claim 1 disposed within the housing, wherein the motor mechanism is mounted directly to the housing.

7. The swing drive assembly of claim 6, wherein the motor mechanism is fixedly attached to the housing.

8. A swing drive mechanism for a swing having a swing seat, at least one hanger arm supporting the swing seat, and a pivot shaft providing reciprocal motion to the swing seat via the at least one hanger arm, the drive mechanism comprising:

a gear;

an eccentric element coupled to the gear;

a motor mechanism configured to drive the gear;

a substantially elongated drive link having a proximal end and a distal end, the proximal end coupled to the gear via the eccentric element; and a spring coupled to, and configured to being driven by, the distal end of the drive link, the spring being configured to directly drive the pivot shaft in a reciprocal fashion, wherein the spring is a spiral spring having coils, the coils being substantially disposed in a single plane.

9. A swing drive mechanism for a swing having a swing seat, at least one hanger arm supporting the swing seat, and a pivot shaft providing reciprocal motion to the swing seat via the at least one hanger arm, the drive mechanism comprising:

a gear;

an eccentric element coupled to the gear;

a motor mechanism configured to drive the gear;

a substantially elongated drive link having a proximal end and a distal end, the proximal end coupled to the gear via the eccentric element; and a spring coupled to, and configured to being driven by, the distal end of the drive link, the spring being configured to directly drive the pivot shaft in a reciprocal fashion, wherein the drive link is arranged such that when driven by the gear, the drive link moves in a direction substantially perpendicular to a radial line from a center of rotation of the spring to a point where the drive link contacts the spring, and wherein the length of the radial line remains substantially constant during the motion.

10. A swing drive mechanism for a swing having a swing seat, at least one hanger arm supporting the swing seat, and a pivot shaft providing reciprocal motion to the swing seat via the at least one hanger arm, the drive mechanism comprising:

a gear;

an eccentric element coupled to the gear;

a motor mechanism configured to drive the gear;

a substantially elongated drive link having a proximal end and a distal end, the proximal end coupled to the gear via the eccentric element; and a spring coupled to, and configured to being driven by, the distal end of the drive link, and configured to drive the pivot shaft, wherein the gear, drive link, and spring are disposed in substantially the same plane.

11. A swing drive mechanism for a swing having a swing seat, at least one hanger arm supporting the swing seat, and a pivot shaft providing reciprocal motion to the swing seat via the at least one hanger arm, the drive mechanism comprising:

a gear;

an eccentric element coupled to the gear;

a motor mechanism configured to drive the gear;

a substantially elongated drive link having a proximal end and a distal end, the proximal end coupled to the gear via the eccentric element; and a spring coupled to, and configured to being driven by, the distal end of the drive link, the spring being configured to directly drive the pivot shaft in a reciprocal fashion, wherein the gear, spring and pivot shaft rotate about respective axes, the respective axes being substantially parallel.

12. A swing drive assembly of a swing, the assembly comprising:

at least one hanger arm adapted for supporting a swing seat;

a blade adapted to be mounted to a frame of the swing;

a pivot shaft engaged with the at least one hanger arm to drive the at least one hanger arm in reciprocal motion, the pivot shaft having a section with a surface shaped in an inverted V, the section being supported by the blade at the surface; and a drive mechanism adapted for driving the pivot shaft in a reciprocal fashion.

13. The swing drive assembly of claim 12, wherein at least one of the pivot shaft and the blade is impregnated with lubricant.

14. The swing drive assembly of claim 12, wherein the blade has a wedge-shaped cross-section with two sides meeting at a top vertex, and making a first angle with respect to each other, and wherein the section includes two sides meeting at a second vertex and making a second angle with respect to each other, wherein the second angle is greater than the first angle, but small enough to resist side-to-side motion of the blade on the section.

15. The swing drive assembly of claim 12, wherein the blade extends directly beneath the pivot shaft at least at a point where the pivot shaft is attached to the hanger arm.

16. The swing drive assembly of claim 12, wherein the blade supports the pivot shaft on both sides of the hanger arm.

17. The swing drive assembly of claim 12, wherein the blade comprises two blades respectively located on opposite sides of the hanger arm.

18. A swing drive mechanism for a swing having a swing seat, at least one hanger arm supporting the swing seat, and a pivot shaft providing reciprocal motion to the swing seat via the at least one hanger arm, the drive mechanism comprising:

an input bracket comprising:

a crank engagement portion;

an axle contacting portion; and a spring coupling portion;

a pivot shaft engagement element configured to engage the pivot shaft; and at least one elongated spring coupling the spring coupling portion to the pivot shaft engagement element.

19. The swing drive mechanism of claim 18, wherein the at least one elongated spring comprises two coil springs.

20. The swing drive mechanism of claim 18, wherein the crank engagement portion comprises a first crank engagement surface and a second crank engagement surface, and wherein the first crank engagement surface faces the second crank engagement surface.

21. The swing drive mechanism of claim 18, wherein the axle contacting portion has an axle hole for contacting an axle, the pivot shaft engagement element has a shaft hole configured to fixedly engage the pivot shaft, and an axis of the axle hole is offset from an axis of the pivot shaft hole.

22. A swing drive mechanism for a swing having a swing seat assembly, comprising:

a gear:

a motor mechanism configured to drive the gear;

a drive link having a proximal end coupled to the gear and having a distal end; and a spring having a first end coupled to and driven by the distal end of the drive link and having a second end in communication with the swing seat assembly to apply energy in two directions to provide reciprocal motion to the swing seat assembly, wherein the spring is configured to directly drive a pivot shaft of the swing seat assembly.

23. A swing comprising:

a swing seat;

at least one hanger arm;

a pivot shaft providing reciprocal motion to the swing seat via the at least one hanger arm; and a swing drive mechanism, comprising:

a motor mechanism; and a spring having a first end communicating with and driven by the motor mechanism and having a second end coupled to the pivot shaft to apply energy in two directions to the pivot shaft, thereby providing reciprocal motion to the at least one hanger arm and the swing seat, in response to torque applied to the spring by the motor mechanism.

24. The swing of claim 23, further comprising:

a gear configured to be driven by the motor mechanism;

an eccentric element coupled to the gear; and a drive link having a proximal end coupled to the gear via the drive link and having a distal end coupled to the first end of the spring.

* * * * *